US007849892B1

(12) United States Patent
Connors et al.

(10) Patent No.: US 7,849,892 B1
(45) Date of Patent: Dec. 14, 2010

(54) BULK SHIPPING, STORAGE AND DISCHARGE BOX

(75) Inventors: Peter J. Connors, Radnor, PA (US); Thomas W. Wise, Lansdale, PA (US); Kenneth Miller, Jr., Spring City, PA (US)

(73) Assignee: Remcon Plastics, Inc., Reading, PA (US)

( * ) Notice: Subject to any disclaimer, the term of this patent is extended or adjusted under 35 U.S.C. 154(b) by 1044 days.

(21) Appl. No.: 11/470,777

(22) Filed: Sep. 7, 2006

(51) Int. Cl.
*B65B 1/04* (2006.01)

(52) U.S. Cl. ..... 141/356; 141/351; 141/352; 141/363; 141/364; 141/365; 222/185.1

(58) Field of Classification Search ..... 141/1, 141/21, 351–354, 356, 360, 363–366; 222/185.1
See application file for complete search history.

(56) References Cited

U.S. PATENT DOCUMENTS

| | | | | |
|---|---|---|---|---|
| 3,123,107 | A * | 3/1964 | Kappler | 141/352 |
| 3,712,019 | A * | 1/1973 | Lamka et al. | 53/459 |
| 4,187,881 | A | 2/1980 | Kull | |
| 4,318,531 | A | 3/1982 | Carlson | |
| 4,813,818 | A * | 3/1989 | Sanzone | 406/122 |
| 5,036,894 | A | 8/1991 | Semenenko | |
| 5,224,635 | A * | 7/1993 | Wise | 222/608 |
| 5,622,291 | A | 4/1997 | Semenenko | |
| 6,199,606 | B1 | 3/2001 | Semenenko | |
| 6,296,152 | B1 | 10/2001 | Semenenko | |
| 6,341,715 | B1 * | 1/2002 | Semenenko | 222/1 |
| 6,568,568 | B1 | 5/2003 | Piepereit | |
| 6,595,735 | B1 | 7/2003 | Lee | |
| 6,623,013 | B1 | 9/2003 | Lee | |
| 6,672,342 | B2 * | 1/2004 | Nussbaumer | 141/83 |
| 6,685,060 | B1 | 2/2004 | Lee | |
| 2005/0045670 | A1 | 3/2005 | Semenenko | |

FOREIGN PATENT DOCUMENTS

| | | |
|---|---|---|
| EP | 524793 | 1/1993 |
| EP | 703161 | 3/1996 |
| EP | 704394 | 4/1996 |
| EP | 1038802 | 9/2000 |
| WO | 93/01997 | 2/1993 |
| WO | 96/10709 | 4/1996 |
| WO | 97/08080 | 3/1997 |

* cited by examiner

*Primary Examiner*—Timothy L Maust
(74) *Attorney, Agent, or Firm*—Caesar, Rivise, Bernstein, Cohen & Pokotilow, Ltd.

(57) ABSTRACT

A discharge box capable of transporting and then dispensing a high bulk density of solid product with substantially no human intervention. The discharge box includes separable/replaceable components allowing for a low cost, low maintenance, and long-term package and includes a tamper-evidence site window, and desiccant pockets, in a lid portion.

11 Claims, 9 Drawing Sheets

BULK SHIPPING, STORAGE AND DISCHARGE BOX

BACKGROUND OF THE INVENTION

1. Field of Invention

This invention relates to containers of solid or bulk material and more particularly to containers that are used for shipping, storing and discharging bulk or solid materials.

2. Description of Related Art

Containers for the shipping and dispensing of solid material are well known. Many of these containers comprise cone valves disposed in the base of the container for permitting the discharge of the solid contents when necessary. However, many of these containers suffer from problems related to damage to the container resulting in the overall container having to be discarded. Thus, there remains a need for providing a container that can be used for shipping, storing and dispensing bulk material (e.g., coin slugs) that is durable, lightweight and having replaceable components that do not require the container itself to be replaced.

All references cited herein are incorporated herein by reference in their entireties.

BRIEF SUMMARY OF THE INVENTION

A discharge box for transporting and for dispensing a high bulk density of solid product (e.g., coin slugs) within an automated material handling system substantially without human intervention. The discharge box comprises: an enclosure (e.g., polyethylene) having a conical shaped lower surface and a discharge port located at the peak of the conical shaped lower surface, wherein the enclosure also has a top opening; a displaceable cone valve (e.g., polyethylene) positioned in the discharge port, wherein the cone valve is displaced against the conical shaped lower surface when the enclosure is initially loaded with the high bulk density of solid product and which closes the cone valve and discharge port, and wherein the displaceable cone valve comprises a cavity for receipt of an actuator from the automated material handling system; a pallet (e.g., polyethylene) releasably secured to the enclosure adjacent the conical shaped lower surface, wherein the pallet forms a support for the enclosure, and wherein the pallet comprises first keying elements that correspond to second keying elements in a lower surface of the enclosure, and wherein the pallet comprises an opening for providing access to the cavity of the displaceable cone to the actuator and for permitting passage of the high bulk density of solid product from the discharge port; and a removable lid (e.g., polyethylene) for closing off the top opening of the enclosure, wherein the lid comprises third keying elements that correspond to fourth keying elements in an upper surface of the enclosure, and wherein the removable lid comprises a window for permitting visual observation of the high bulk density of solid product.

A method for providing the transportation and dispensing of a high bulk density solid product (e.g., coin slugs) within an automated material handling system substantially without human intervention using a low cost, low maintenance, and long-term package. The method comprises: providing a double-walled enclosure (e.g., polyethylene) whose walls are filled with foam and wherein the enclosure includes a conical shaped lower surface and a discharge port located at the peak of the conical shaped lower surface, and wherein the enclosure also has a top opening; positioning a displaceable cone valve (e.g., polyethylene) in the discharge port against the conical shaped lower surface to close the discharge port, wherein the displaceable cone comprises a cavity for receipt of an actuator from the automated material handling system; releasably securing a pallet (e.g., polyethylene) to the enclosure adjacent the conical shaped lower surface, wherein the pallet forms a support for the enclosure, wherein the pallet comprises first keying elements that correspond to second keying elements in a lower surface of the enclosure, and wherein the pallet comprises an opening for providing access to the cavity of the displaceable cone to the actuator and for permitting passage of the high bulk density of solid product from the discharge port; filling the enclosure through the top opening with the high bulk density of solid product which loads against the cone valve to close the discharge port; positioning a removable lid (e.g., polyethylene) over the top opening of the filled enclosure and releasably securing the lid to the enclosure, wherein the lid comprises third keying elements that correspond to fourth keying elements in an upper surface of the enclosure, and wherein the removable lid comprises a window for permitting visual observation of the high bulk density of solid product, and wherein the enclosure, pallet and lid form a discharge box; transporting the filled discharge box to the automated material handling system; positioning the filled discharge box at a discharge station of the automated material handling system and aligning the filled discharge box such that the cone valve cavity is aligned with a discharge station actuator; and activating the discharge station actuator to engage the cone valve cavity and displace the cone valve away from the discharge port to dispense the high bulk density solid product into a hopper of the discharge station.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Figure 1:
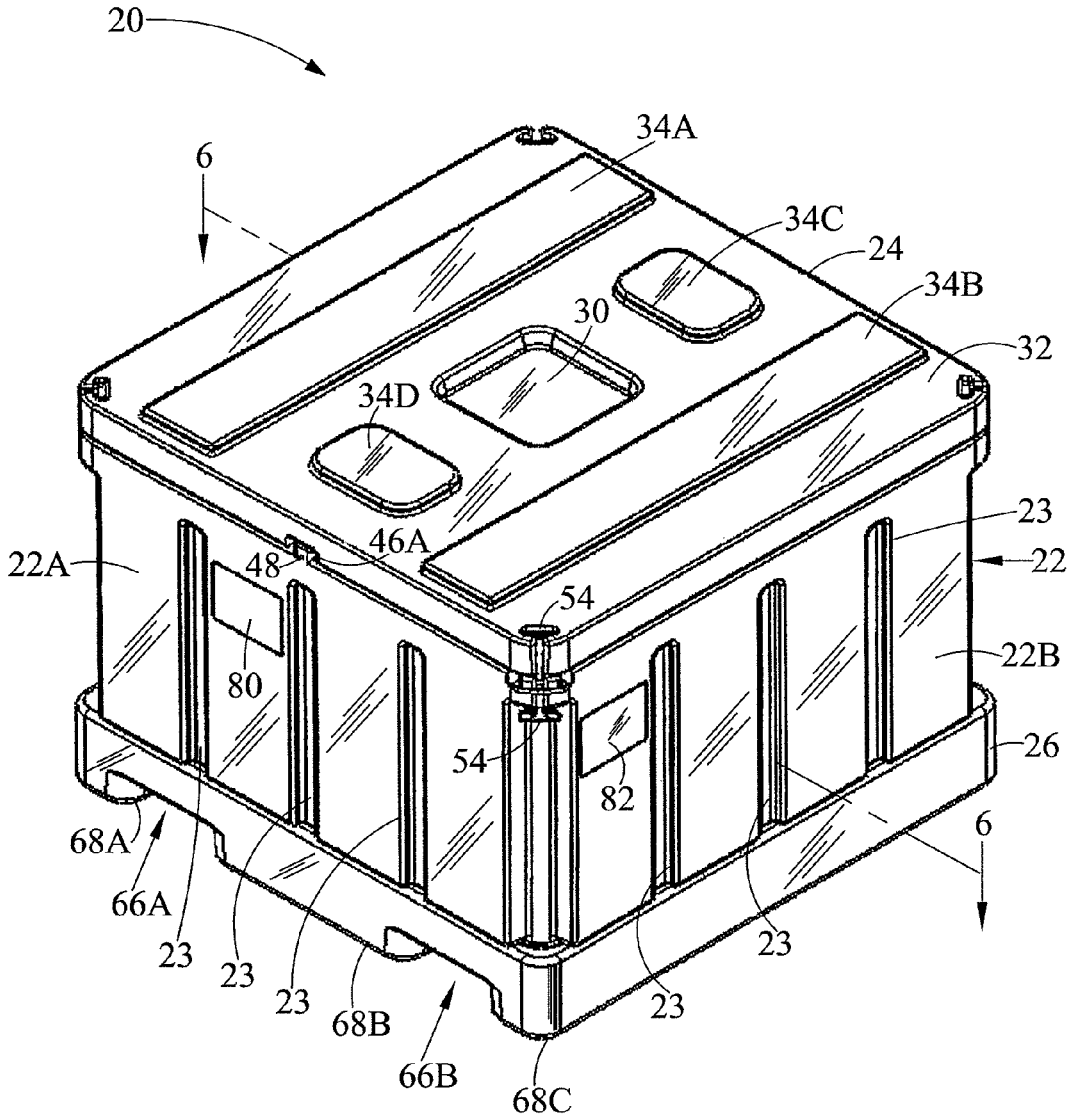
FIG. 1 is an isometric view of the discharge box of the present invention.
Figure 6:
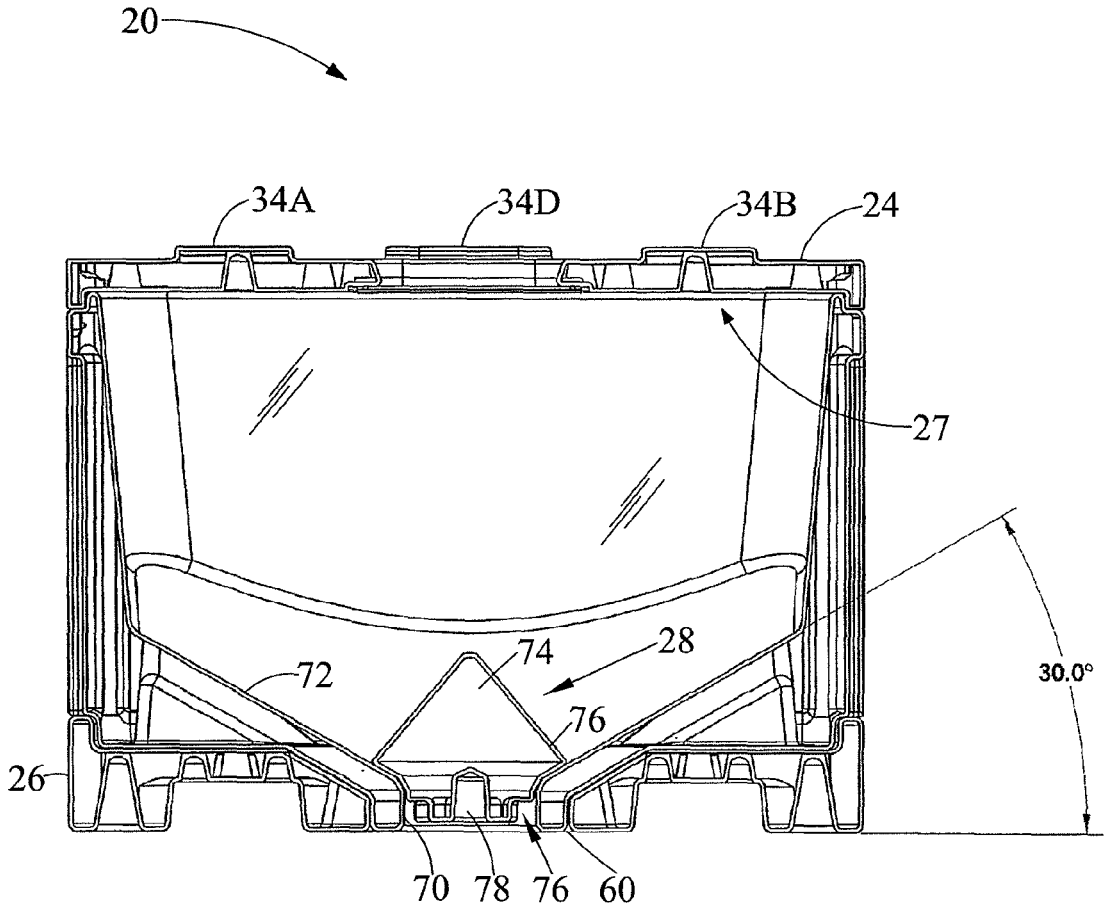
FIG. 6 is a cross-sectional view of the discharge box of the present invention taken along line 6-6 of FIG. 1 and depicting all of the plastic portions with no foam disposed therein.

As shown in FIG. 1, the present invention or discharge box 20 comprises a discharge box enclosure 22, a lid 24, a removable pallet 26 and a cone valve 28 (FIG. 6). These components cooperate to provide a discharge box that is capable of transporting and then dispensing a high bulk density solid product (e.g., coin slugs, not shown) within an automated material handling system without, or substantially without, human intervention. The separable/replaceable components allow for a low cost, low maintenance, and long-term transportation and discharge package. All of these components may comprise plastic, e.g., polyethylene.

The enclosure 22 itself comprises four walls, two of which 22A (a front wall) and 22B (a side wall) are shown in FIG. 1. The four walls are four molded plastic double-walled foam filled components, although a portion of the foam (25) is only shown in FIG. 9. The foam provides a rigidity to the enclosure 22 because the solids products that can be transported and discharged from the present invention 20 comprise bulk densities up to and including 250 lbs/ft$^3$; especially due to settling during transportation. Gussets 23 are also provided in the four walls to enhance the strength of the enclosure 22.

Figure 7:
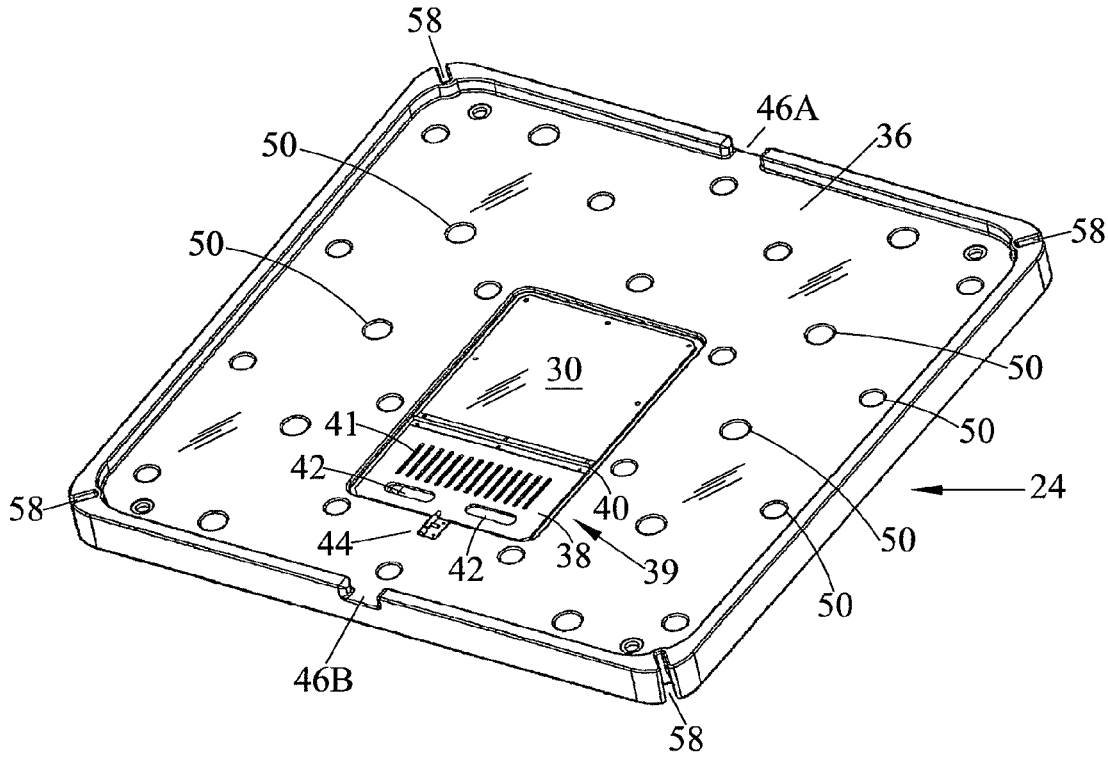
FIG. 7 is an isometric view of the underside of the lid of the discharge box.

The lid 24 comprises, among other things, a tamper-evidence site window 30 (e.g., a 3/16" thick polycarbonate view port). Thus, it is possible to view the bulk contents, if necessary, through this site window 30. Included on the outside surface 32 of the lid 24 are pallet locating guides or guide elements (34A, 34B, 34C and 34D) that facilitate the stacking of a plurality of these discharge boxes 20. On the inside surface 36 (FIG. 7) of the lid 24, a depression 39 in the lid 24 which contains desiccant pockets (not shown). These pockets are secured in the depression 39 by a cover 38 that is hinged 40. Vent holes 41 in the cover 38 are provided for the desiccant pockets to absorb any moisture that gains access into the enclosure 22. Finger grasps 42 permit one to open the cover 38 (once a latch 44 is opened). Another important aspect of the present invention 20 is that the lid 24 comprises keys or keying elements 46A and 46B that permit the lid 24 to be engaged with the enclosure 22 in only two directions. In particular, as most clearly seen in FIGS. 1 and 2, the top surface of the enclosure 22 comprises corresponding keys, keying elements or interlocks (only one, 48, of which is shown). As a result, the lid 24 can be engaged with the enclosure 22 only if the keys 46A/46B are aligned with the corresponding keys of the enclosure 22. To provide further strength to the lid 24, conical depressions 50 are dispersed through the inside surface 36 of the lid 24. The lid 24 closes off an opening 27 (see FIG. 6) formed at the top of the enclosure 22. The bulk material is initially loaded into the enclosure 22 through this opening and then the lid 24 is installed as described above. Thus, it should be understood that the lid 24 is not used for discharging the bulk content; rather that is accomplished using the cone valve 28, as will be discussed later.

To secure the lid 24 to the enclosure 22, a plurality of bungees or rubber tie-downs 52 are provided. As seen most clearly in FIG. 1, the tie-downs 52 comprise tees 54. With the lid 24 properly keyed, as discussed previously, the tie downs 52 are inserted into corresponding grooves or receptacles 56 (in the enclosure 22; see FIG. 3) and 58 (in the lid 24; see FIG. 7) and the tees 54 lock against the enclosure 22 and lid 24 (see FIGS. 2 and 4).

Figure 4:
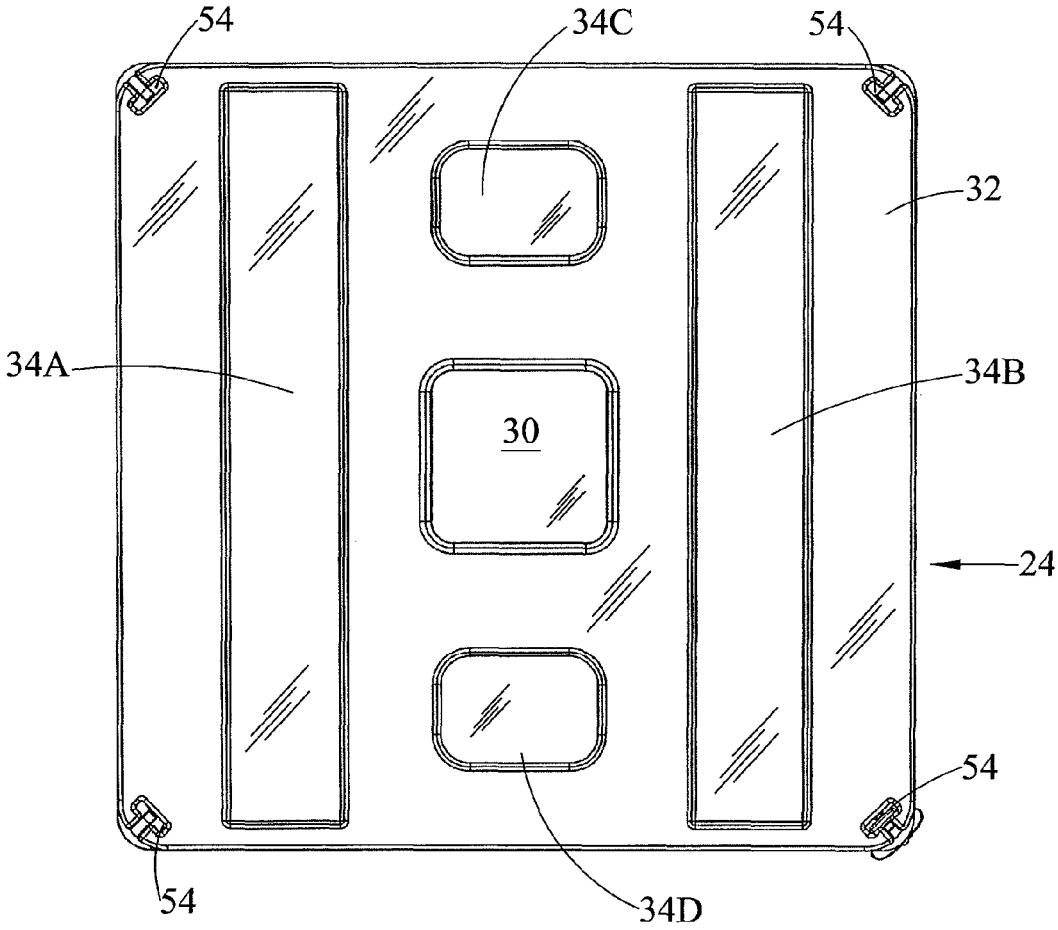
FIG. 4 is a top plan view of the discharge box of the present invention showing the top of the lid.
Figure 5:
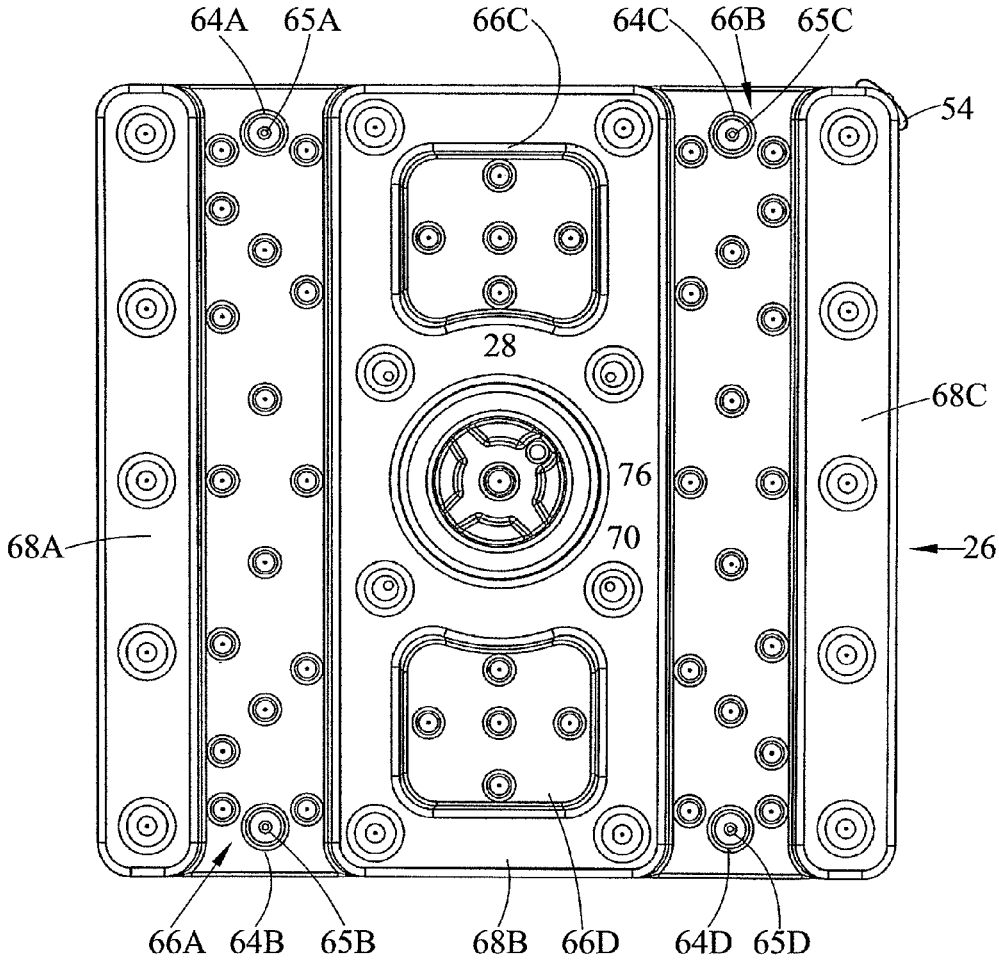
FIG. 5 is a bottom plan view of the discharge box showing the removable pallet coupled to the discharge box.
Figure 8:
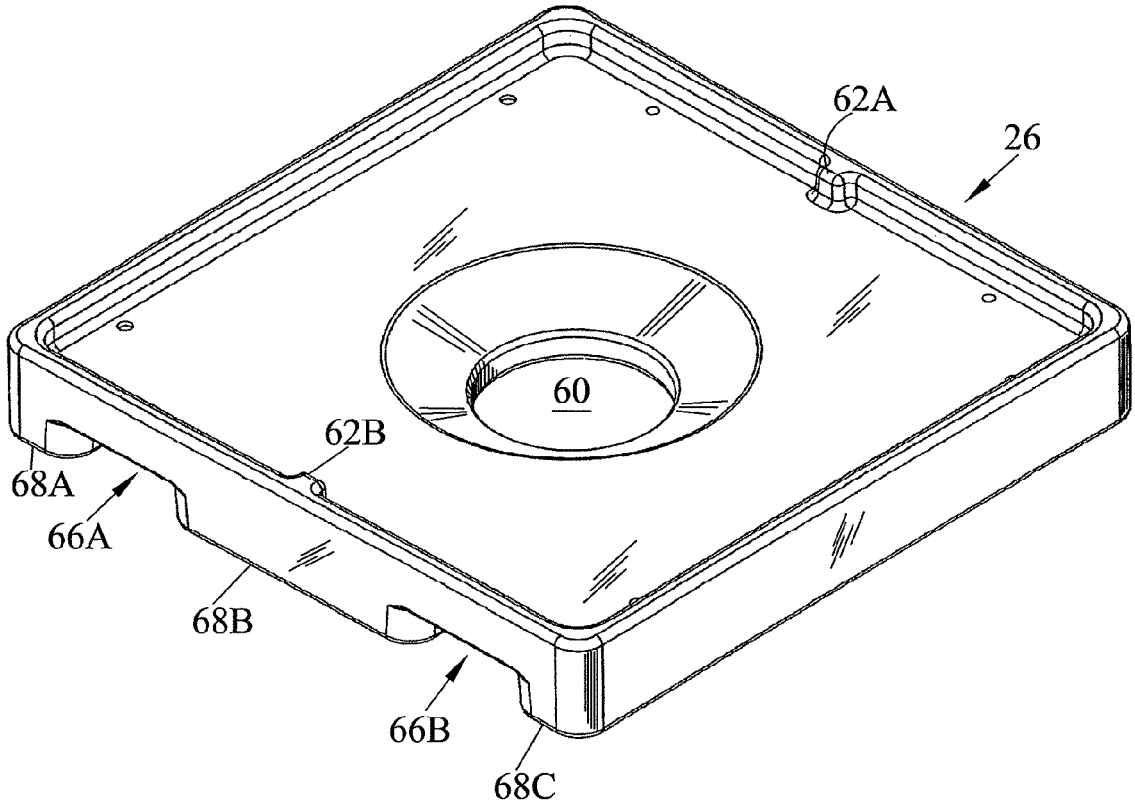
FIG. 8 is an isometric view of the removable pallet of the discharge box.

Another key feature of the present invention 20 is the removable pallet 26 (FIG. 8). Most conventional bulk containers comprise integrated pallets that, over time, wear or are damaged (e.g., fork lift tine contact, loading, etc.). Although the container itself that holds the contents may be undamaged, the damaged integrated pallet makes the overall container unusable. The end result is that the entire container has to be discarded. In contrast, the present invention 20 permits the removal of the pallet 26 from the enclosure 22, if necessary. The pallet 26 comprises an opening 60 to permit the cone valve 28 to pass therethrough, as will be discussed later. Like the lid 24, the pallet 26 is also keyed or interlocked to permit the pallet 26 to be installed in only two directions; in particular, keys or keying elements 62A and 62B are designed to engage mating keys or keying elements (not shown) in the bottom edge of the enclosure 22. As shown most clearly in FIG. 5, counterbores 64A-64D are provided in the enclosure 22 forming threaded inserts while corresponding aligned through-holes 65A-65D are provided in the pallet 26 to permit the passage of fasteners (not shown, e.g., 3/8" bolts) therethrough. These fasteners are tightened to releasably secure the pallet 26 to the enclosure 22. Passages 66A and 66B (FIG. 8) in the pallet 26 permit fork lift tines (not shown) to pass therethrough in order to lift the present invention 20 once it is filled. As mentioned earlier, these passages 66A/66B also receive the pallet locating guides 34A and 34B (FIGS. 1 and 4) when a plurality of these discharge boxes 20 are stacked. Furthermore, recesses 66C and 66D (FIG. 5) in the bottom surface of the pallet 26 are also provided so that during stacking these recesses align with the other pallet locating guides 34C/34D (FIGS. 1 and 4). The pallet 26 comprises three box support portions, namely, 68A, 68B and 68C (FIGS. 5 and 8).

FIG. 6 depicts a cross-sectional view of the discharge box 20 but without the bulk contents shown. The cone valve 28 is freely-positioned in an opening or port 70 that passes through the opening 60 in the pallet 26. As can be seen in FIG. 6, the lower surface of the enclosure 22 comprises conical shape 72 that directs the bulk contents (not shown) toward the port 70. By way of example only, the angle of this conical shape formed with a horizontal reference is approximately 30°. The cone valve 28 comprises a head 74 that is also conical in shape. The lower end of the head 74 comprises a shoulder 76 that contacts the opening to the port 70, and closes off the port 70 when properly seated in the port. The cone valve 28 also comprises a neck 76 that resides in the port 70. The neck 76 also comprises a cavity 78 for receiving an actuator from an external hopper device, as will be discussed later. By way of example only, this cavity 78 may comprise a 2-3 inch diameter for receiving a corresponding actuator. Thus, as can be seen in FIG. 6, the cone valve 28 is in a closed position since the shoulder 76 is in contact with the lower surface 72 of the enclosure 22 and any bulk contents (not shown) would be prevented from gaining access to the port 70. As can be appreciated from that figure, that weight of the bulk contents loads the head 74 downward, thereby maintaining the shoulder 76 in tight contact with the lower surface 72. As a result, once the discharge box 20 is filled with the bulk contents, and the lid 24 secured thereon, as discussed previously, the discharge box 20 can be shipped (and stacked with other similar discharge boxes 20) by rail car, truck, etc., to its destination, typically a discharge station.

Figure 9:
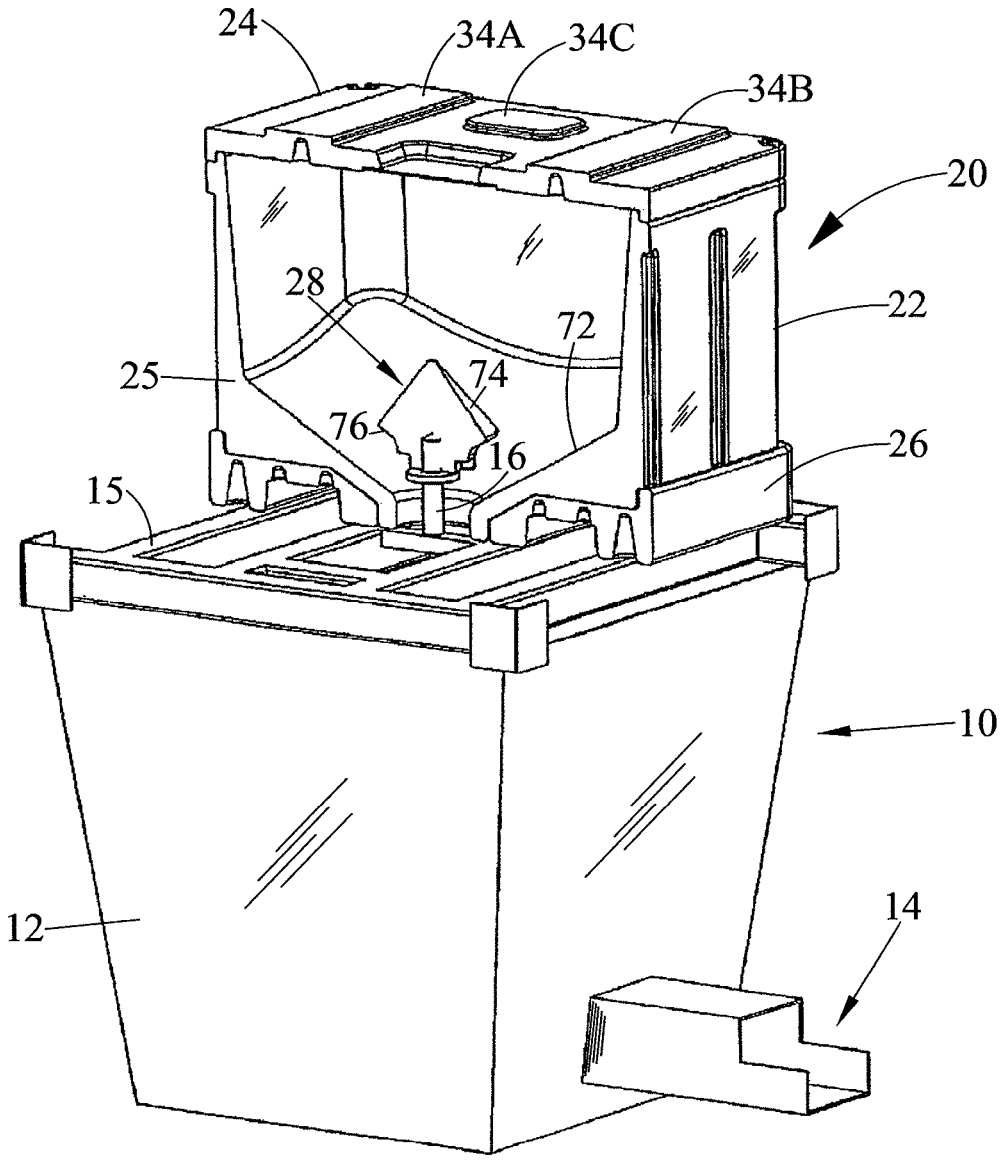
FIG. 9 is an isometric view of the discharge box, shown in cross-section, disposed on top of a hopper for receiving the contents (not shown) from the discharge box which includes a discharge actuator that is shown activating the cone valve of the discharge box.

FIG. 9 depicts, by way of example only, a hopper 10 for collecting the bulk contents from these discharge boxes 20. The hopper 10 broadly represents an automated bulk material handling system, substantially without human intervention. For ease of explanation, the discharge box 20 of the present invention is shown in cross-section on top of the hopper 10. The hopper 10 comprises a receiving bin 12 and an outlet 14. The hopper 10 also comprises a mechanism for actuating the cone valve 28 of the discharge box 20. This mechanism may be a fixed pin, or an actuator (e.g., mechanically, or electrically, or hydraulically-activated, etc.) that enters the cavity 78 of the cone valve 28. Hereinafter, the term "actuator" 16 is meant to broadly construe any hopper mechanism that can fit into the cavity 78. When the filled discharge box 20 is positioned on the hopper 10, the hopper's top surface 15 is formed to mate or register (e.g. using alignment or fixed stops) with the pallet's support surfaces 68A-68C and/or passages 66A-66B such that the hopper actuator 16 is engaged within the valve cavity 78. This engagement of, or upward movement of, the actuator 16 lifts the cone valve upward into the enclosure 22, against the entire load of the bulk contents, known as "breaking the load free." This causes the shoulder 76 to lose contact with the lower surface 72 of the enclosure 22, thereby opening the port 70. The bulk content presses downward from its own load, riding along the conical surface 72 and out through the port 70 and down into the receiving bin 12 of the hopper 10. The hopper 10 then passes the contents of the receiving bin 12 out of its outlet 14. Operation of the actuator 16 is typically automatically controlled and should the receiving bin 12 be filled, the actuator 16 may be interlocked or otherwise prevented from activating the cone valve 28 until the receiving bin 12 is evacuated. This prevents "choking" of the receiving bin 12.

It should be understood that many different types of hopper configurations are available; for example, the filled discharge boxes 20 can be initially provided on a conveyor which transports each box 20 to a receiving hopper 10. Optical or electrical sensors may precisely position the discharge box 20 in order to properly register the actuator 16 with the cone valve 28.

It should be further understood that using the disclosed configuration of the discharge box 20, activation of the cone valve 28 to cause "breaking the load," results in all of the bulk content being discharged from the box 20, thereby minimizing any residual content remaining in the discharge box 20.

It should also be noted that, although not shown, a securing pin can be positioned through the cone valve 28 in the discharge box 20 before the discharge box 20 is loaded with the bulk contents. When the discharge box 20 is ready to receive these contents, the pin is removed.

Figure 2:
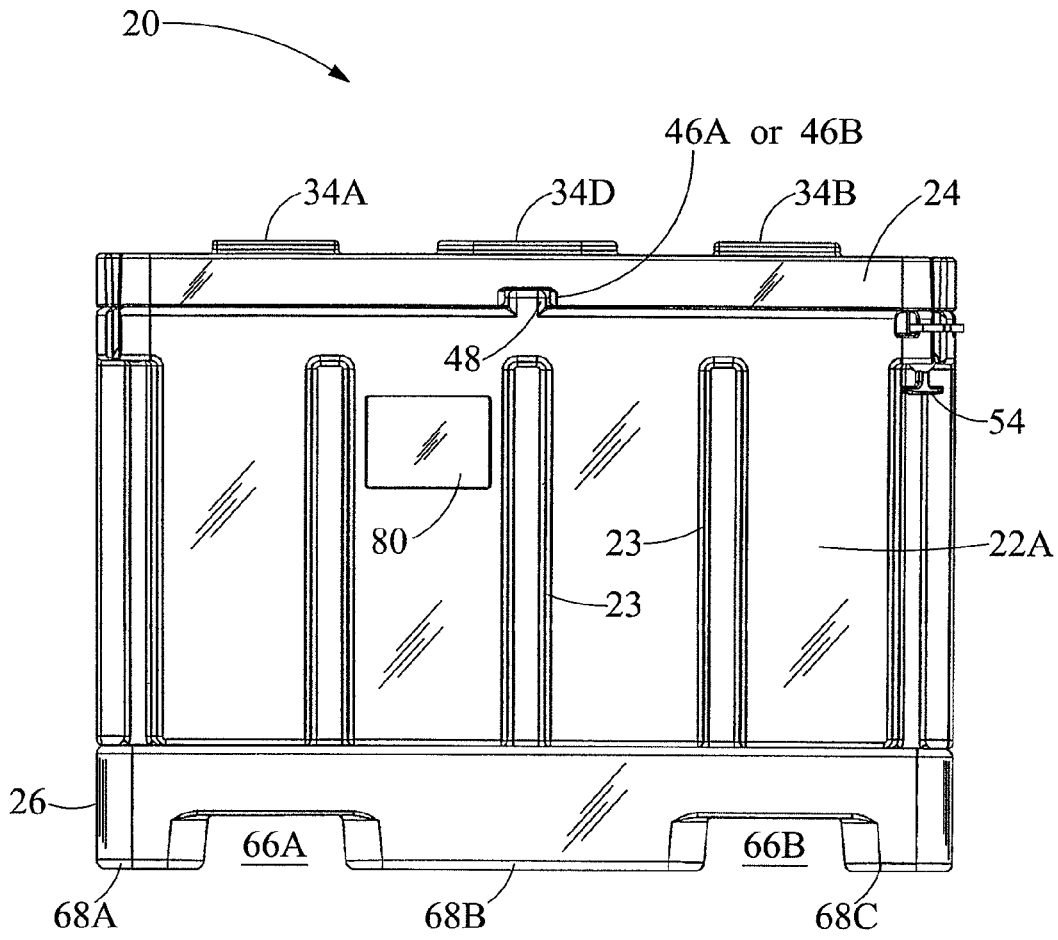
FIG. 2 is a front view of the discharge box of the present invention.
Figure 3:
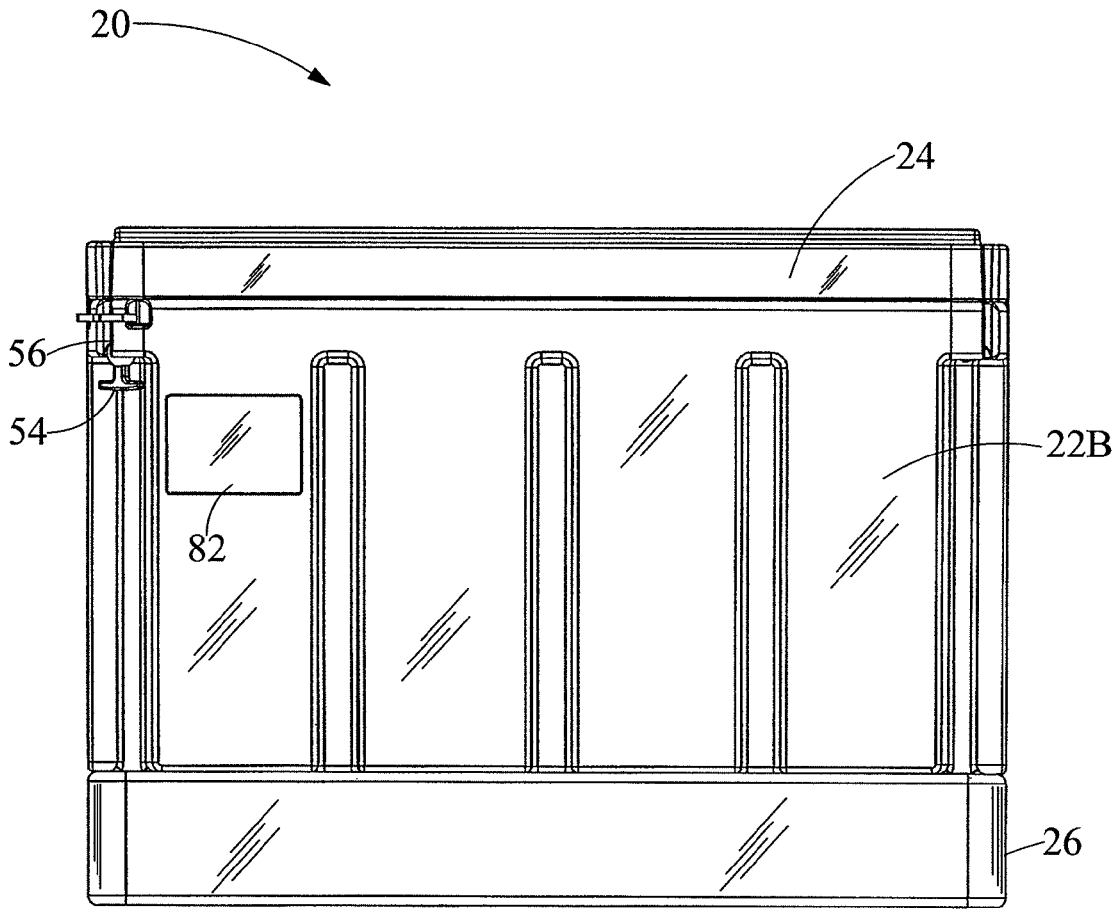
FIG. 3 is a side view of the discharge box of the present invention.

Label recesses (only two of which, 80 and 82, are shown in FIGS. 1-3) are provided in the four wall of the enclosure 22. These recesses protect any applied labels therein from contact by adjacent containers or other items that may ride along the walls of the enclosure 22.

It should also be noted that all of the plastic components, e.g., the enclosure 22, the lid 24, the pallet 26, etc. are also filled with foam for rigidity.

While the invention has been described in detail and with reference to specific examples thereof, it will be apparent to one skilled in the art that various changes and modifications can be made therein without departing from the spirit and scope thereof.

What is claimed is:

1. A discharge box for transporting and for dispensing a high bulk density of solid product within an automated material handling system substantially without human intervention, said discharge box comprising:

an enclosure having a conical shaped lower surface and a discharge port located at the peak of said conical shaped lower surface, said enclosure also having a top opening;

a displaceable cone valve positioned in said discharge port, said cone valve being displaced against said conical shaped lower surface when said enclosure is initially loaded with the high bulk density of solid product and which closes said cone valve and discharge port, said displaceable cone valve comprising a cavity for receipt of an actuator from the automated material handling system;

a pallet releasably secured to said enclosure adjacent said conical shaped lower surface, said pallet forming a support for said enclosure, said pallet comprising first keying elements that correspond to second keying elements in a lower surface of said enclosure, said pallet comprising an opening for providing access to said cavity of said displaceable cone to the actuator and for permitting passage of the high bulk density of solid product from said discharge port; and a removable lid for closing off said top opening of said enclosure, said lid comprising third keying elements that correspond to fourth keying elements in an upper surface of said enclosure, said removable lid comprising a window for permitting visual observation of the high bulk density of solid product; and wherein said removable lid further comprises desiccant pockets positioned against an inner side of said lid by a releasable cover and wherein said cover comprises vent holes.

2. A discharge box for transporting and for dispensing a high bulk density of solid product within an automated material handling system substantially without human intervention, said discharge box comprising:

an enclosure having a conical shaped lower surface and a discharge port located at the peak of said conical shaped lower surface, said enclosure also having a top opening;

a displaceable cone valve positioned in said discharge port, said cone valve being displaced against said conical shaped lower surface when said enclosure is initially loaded with the high bulk density of solid product and which closes said cone valve and discharge port, said displaceable cone valve comprising a cavity for receipt of an actuator from the automated material handling system;

a pallet releasably secured to said enclosure adjacent said conical shaped lower surface, said pallet forming a support for said enclosure, said pallet comprising first keying elements that correspond to second keying elements in a lower surface of said enclosure, said pallet comprising an opening for providing access to said cavity of said displaceable cone to the actuator and for permitting passage of the high bulk density of solid product from said discharge port; and a removable lid for closing off said top opening of said enclosure, said lid comprising third keying elements that correspond to fourth keying elements in an upper surface of said enclosure, said removable lid comprising a window for permitting visual observation of the high bulk density of solid product; and wherein said lid comprises pallet guide elements that permit a second discharge box to be stacked on top of said lid.

3. A discharge box for transporting and for dispensing a high bulk density of solid product within an automated material handling system substantially without human intervention, said discharge box comprising:

an enclosure having a conical shaped lower surface and a discharge port located at the peak of said conical shaped lower surface, said enclosure also having a top opening, a displaceable cone valve positioned in said discharge port, said cone valve being displaced against said conical shaped lower surface when said enclosure is initially loaded with the high bulk density of solid product and which closes said cone valve and discharge port, said displaceable cone valve comprising a cavity for receipt of an actuator from the automated material handling system;

a pallet releasably secured to said enclosure adjacent said conical shaped lower surface, said pallet forming a support for said enclosure, said pallet comprising first keying elements that correspond to second keying elements in a lower surface of said enclosure, said pallet comprising an opening for providing access to said cavity of said displaceable cone to the actuator and for permitting passage of the high bulk density of solid product from said discharge port; and a removable lid for closing off said top opening of said enclosure, said lid comprising third keying elements that correspond to fourth keying elements in an upper surface of said enclosure, said removable lid comprising a window for permitting visual observation of the high bulk density of solid product; and wherein said pallet is releasably secured to said enclosure using a plurality of fasteners.

4. A discharge box for transporting and for dispensing a high bulk density of solid product within an automated material handling system substantially without human intervention, said discharge box comprising:

an enclosure comprising polyethylene and having a conical shaped lower surface and a discharge port located at the peak of said conical shaped lower surface, said enclosure also having a top opening;

a displaceable cone valve positioned in said discharge port, said cone valve being displaced against said conical shaped lower surface when said enclosure is initially loaded with the high bulk density of solid product and which closes said cone valve and discharge port, said displaceable cone valve comprising a cavity for receipt of an actuator from the automated material handling system;

a pallet releasably secured to said enclosure adjacent said conical shaped lower surface, said pallet forming a support for said enclosure, said pallet comprising first keying elements that correspond to second keying elements in a lower surface of said enclosure, said pallet comprising an opening for providing access to said cavity of said displaceable cone to the actuator and for permitting passage of the high bulk density of solid product from said discharge port; and a removable lid for closing off said top opening of said enclosure, said lid comprising third keying elements that correspond to fourth keying elements in an upper surface of said enclosure, said removable lid comprising a window for permitting visual observation of the high bulk density of solid product; and wherein said enclosure comprises four molded, double-walls that are filled with foam.

5. The discharge box of claim 4 wherein each of said four walls comprises a plurality of vertically-oriented gussets.

6. A method for providing the transportation and dispensing of a high bulk density solid product within an automated material handling system substantially without human intervention using a low cost, low maintenance, and long-term package, said method comprising:

providing a double-walled enclosure whose walls are filled with foam and wherein said enclosure includes a conical shaped lower surface and a discharge port located at the peak of said conical shaped lower surface, said enclosure also having a top opening;

positioning a displaceable cone valve in said discharge port against said conical shaped lower surface to close said discharge port, said displaceable cone comprising a cavity for receipt of an actuator from the automated material handling system;

releasably securing a pallet to said enclosure adjacent said conical shaped lower surface, said pallet forming a support for said enclosure, said pallet comprising first keying elements that correspond to second keying elements in a lower surface of said enclosure, said pallet comprising an opening for providing access to said cavity of said displaceable cone to the actuator and for permitting passage of the high bulk density of solid product from said discharge port;

filling said enclosure through said top opening with the high bulk density of solid product which loads against said cone valve to close said discharge port;

positioning a removable lid over said top opening of said filled enclosure and releasably securing said lid to said enclosure, said lid comprising third keying elements that correspond to fourth keying elements in an upper surface of said enclosure, said removable lid comprising a window for permitting visual observation of the high bulk density of solid product, said enclosure, pallet and lid forming a discharge box;

transporting said filled discharge box to the automated material handling system;

positioning said filled discharge box at a discharge station of the automated material handling system and aligning said filled discharge box such that said cone valve cavity is aligned with a discharge station actuator; and activating said discharge station actuator to engage said cone valve cavity and displacing said cone valve away from said discharge port to dispense the high bulk density solid product into a hopper of the discharge station.

7. The method of claim 6 further comprising providing a window in said lid for viewing the high bulk density solid product that is loaded into said enclosure.

8. The method of claim 6 further comprising providing desiccant pockets on an inner surface of said lid.

9. The method of claim 7 further comprising including pallet guide elements on an outside surface of said lid for supporting another discharge box to be stacked on top of said lid.

10. The method of claim 6 wherein said conical shaped lower surface comprises an angle of approximately 30° with respect to a horizontal reference.

11. The method of claim 9 wherein said step of transporting said filled discharge box comprises transporting a plurality of filled discharge boxes stacked on top of each other.

* * * * *